US006481998B2

(12) United States Patent
Payne et al.

(10) Patent No.: US 6,481,998 B2
(45) Date of Patent: Nov. 19, 2002

(54) HIGH VELOCITY REBURN FUEL INJECTOR

(75) Inventors: Roy Payne, Mission Viejo, CA (US); Quang Nguyen, Mission Viejo, CA (US); David Moyeda, Mission Viejo, CA (US)

(73) Assignee: GE Energy and Environmental Research Corporation, Irvine, CA (US)

( * ) Notice: Subject to any disclaimer, the term of this patent is extended or adjusted under 35 U.S.C. 154(b) by 0 days.

(21) Appl. No.: 08/483,441

(22) Filed: Jun. 7, 1995

(65) Prior Publication Data

US 2002/0045140 A1 Apr. 18, 2002

(51) Int. Cl.[7] ..... F23C 7/02; F23D 11/38; F23D 13/20; F23D 1/00

(52) U.S. Cl. ..... 431/5; 431/8; 431/187

(58) Field of Search ..... 239/132.5, 425, 239/424, 596; 431/8, 160, 187, 2, 174, 12, 159, 162, 5, 202; 110/347, 262, 264, 212, 345, 213; 422/181, 182; 60/733, 303

(56) References Cited

U.S. PATENT DOCUMENTS 765,534 A * 7/1904 Williams
1,151,258 A * 8/1915 Fisher ..... 239/596
1,721,484 A * 7/1929 Heyh ..... 431/160
1,950,044 A * 3/1934 Wison ..... 431/8
2,138,998 A * 12/1938 Brosius ..... 431/8
2,618,325 A * 11/1952 Seitz ..... 431/8
2,810,433 A * 10/1957 Gaucher ..... 239/132.5
2,838,105 A * 6/1958 Eastman et al. ..... 431/160
3,051,100 A * 8/1962 Singleton
3,236,281 A * 2/1966 Bain et al. ..... 431/12
3,266,552 A * 8/1966 Denis ..... 431/8
3,408,167 A * 10/1968 Burben, Jr.
3,567,399 A * 3/1971 Altmann et al.
3,695,192 A * 10/1972 Von Brimer
3,724,401 A * 4/1973 Krumm
3,729,285 A 4/1973 Schwedersky ..... 431/8

(List continued on next page.)

FOREIGN PATENT DOCUMENTS

DE 3604304 * 8/1987 ..... 239/424
GB 2109 * 12/1901 ..... 110/213
SU 1179016 * 9/1985 ..... 431/8
WO WO 88/03634 * 5/1988 ..... 110/212

*Primary Examiner*—Carl D. Price
(74) *Attorney, Agent, or Firm*—McAndrews, Held & Malloy, Ltd.

(57) ABSTRACT

An apparatus and method for high velocity injection of a stream of fluid fuel into a stream of $NO_x$ containing combustion effluents downstream of a primary combustion zone, without the use of recirculated flue gas or other carrier gas. The apparatus includes a fuel introducing member that has a fuel receiving end for receiving fluid fuel from a fuel source and a fuel injection end for injecting the fluid fuel into the stream of combustion effluents. A fuel passage is in fluid communication with the fuel receiving end and the fuel injection end of the fuel introducing member. A means for increasing the velocity of the fluid fuel, without the need of a carrier gas, is associated with the fuel introducing member.

9 Claims, 4 Drawing Sheets

U.S. PATENT DOCUMENTS 3,780,530 A 12/1973 Dooley et al. ..... 60/39.69
3,780,674 A * 12/1973 Liu
3,864,072 A * 2/1975 Abernathy et al.
3,881,870 A * 5/1975 Hatfield
3,893,810 A * 7/1975 Lientz ..... 431/5
4,320,875 A * 3/1982 Sutter ..... 239/462
4,345,529 A * 8/1982 Weber et al. ..... 431/5
4,403,941 A 9/1983 Okiura et al. ..... 431/10
4,419,074 A * 12/1983 Schuetz ..... 431/354
4,466,359 A * 8/1984 Weber et al.
4,496,306 A * 1/1985 Okigami et al. ..... 431/8
4,642,047 A * 2/1987 Gitman ..... 431/13
4,645,449 A 2/1987 Schwartz et al. ..... 431/8
4,403,941 A 7/1988 Okiura et al. ..... 431/10
4,783,325 A * 11/1988 Jones
4,960,059 A * 10/1990 Berkau et al. ..... 110/347
5,078,064 A * 1/1992 Breen et al.
5,087,175 A * 2/1992 Raizman et al. ..... 417/196
5,158,443 A 10/1992 Miyake ..... 431/8
5,158,445 A 10/1992 Khinkis ..... 431/10
5,201,650 A * 4/1993 Johnson ..... 431/9
5,209,656 A * 5/1993 Kobayashi et al. ..... 431/187
5,213,492 A 5/1993 Ho ..... 431/10
5,242,295 A 9/1993 Ho ..... 431/10
5,249,952 A 10/1993 West et al. ..... 431/5
5,252,298 A * 10/1993 Jones et al. ..... 422/172
5,275,552 A 1/1994 Schwartz et al. ..... 431/10
5,332,386 A * 7/1994 Hosome et al. ..... 431/12
5,366,699 A * 11/1994 Milfeld et al.
5,443,805 A * 8/1995 Beer et al.
5,449,286 A * 9/1995 Snyder et al. ..... 431/9

* cited by examiner

HIGH VELOCITY REBURN FUEL INJECTOR

BACKGROUND OF THE INVENTION

1. Field of the Invention

The present invention is directed to a method and apparatus for the control of $NO_x$ emissions. More particularly, the present invention is directed to an apparatus and improved method of reburning for reducing $NO_x$ emissions from combustion systems such as power plants, boilers, process furnaces including glass furnaces, incinerators, and the like. Through the use of high velocity injection of reburn fuel, the present invention provides an apparatus and method for $NO_x$ reduction without the need for recirculated flue gas.

2. Technology Review

Combustion of fossil fuels, especially coals and heavy oils, produces a significant amount of $NO_x$ which ultimately participates in the formation of smog and acid rain. Combustion modification techniques, including staged combustion and reburning, have been effective in achieving up to 60% $NO_x$ reductions.

Reburning is a controlled process which uses fuel to reduce oxides of nitrogen that are collectively referred to as $NO_x$. These oxides include NO (nitric oxide), $NO_2$ (nitrogen dioxide), $N_2O_4$ (dinitrogen tetroxide), and $N_2O$ (nitrous oxide). In the reburning process, a fraction of the fuel, typically between 10% to 20% of the total heat input, is injected above (i.e., downstream of) the main heat release zone to produce an oxygen deficient reburning zone. The combustion of reburning fuel forms hydrocarbon radicals which react with nitric oxide to form molecular nitrogen, thus reducing $NO_x$. This process occurs best in the absence of oxygen. Subsequently, burnout air is injected downstream to combust the remaining fuel fragments and convert the exiting HCN and $NH_3$ species to either NO or $NO_2$.

Previous studies have shown that 60% reduction in $NO_x$ emissions can be achieved with natural gas reburning and that most of the reduction occurs in the reburning zone. $NO_x$ reduction in the burnout zone, via the HCN and $NH_3$ species from the reburning zone, can occur depending upon the temperature in that region. As is often the case in most utility boilers, however, $NO_x$ reduction in the burnout is minimal because of the high burnout temperature (2200°–2400° F.) and the presence of an excessive amount of carbon monoxide ("CO", above 2% at 0.9 stoichiometry).

The overall reburning process can be divided conceptually into three zones as follows:

Primary Zone: This main heat release zone normally accounts for approximately 80 percent of the total heat input to the system and is operated under fuel lean conditions. The level of $NO_x$ exiting this zone is defined to be the input to the reburning process. If sufficient residence time is not provided, unburned fuel fragments may leave this zone and enter the reburning zone.

Reburning Zone: The reburning fuel is injected downstream of the primary zone to create a fuel rich, $NO_x$ reduction zone. Reactive nitrogen enters this zone from two sources: the primary $NO_x$ created in the main heat release zone and the fuel nitrogen, if any, in the reburn fuel. These reactive nitrogen species react with the hydrocarbon fragments formed during the partial oxidation of the reburning fuel, primarily CH species, to produce intermediate species such as HCN and $NH_3$. Additionally, some nitrogen is converted to $N_2$ and some is retained as NO. If the reburning fuel is a solid such as coal, nitrogen may also leave this zone as char nitrogen.

Burnout Zone: In this final zone, air is added to produce overall lean conditions and to oxidize all of the remaining fuel fragments. The total fixed nitrogen species (TFN=$NH_3$+HCN+NO+char nitrogen) will be either oxidized to $NO_x$ or reduced to molecular nitrogen.

The application of reburning technology to industrial and utility combustion systems requires a technique for effective entrainment and penetration of the reburning fuel, such as natural gas, with the combustion products from the main combustion zone, in order to achieve the highest overall $NO_x$ reduction. This is difficult to achieve because it requires the mixing of a relatively small amount of reburn fuel (typically between two to three percent of the total fuel mass input) with flue gas having a relatively much larger cross-section (in comparison to the area of the introduced stream of reburn fuel). It will be understood, therefore, that it is particularly difficult to achieve the desired entrainment and penetration of low mass reburn fuels, such as natural gas. This problem is exacerbated when the source of reburn fuel is provided at a low flow rate.

In conventional systems, satisfactory penetration and entrainment of the reburning fuel have been achieved by increasing the momentum of the reburn fuel jet, which is typically provided at a low source flow rate, by introducing recirculated flue gas through the reburn fuel nozzles. The flue gas is typically fed to the reburn fuel injectors under pressure, by way of a blower, compressor, or the like. Alternatively, flue gas may be educted at the reburn fuel port. In this manner, the reburning fuel is injected with sufficient force to achieve adequate penetration into, and entrainment with, the combustion effluents.

The use of flue gas recirculation to enhance the mixing of reburn fuel is expensive, however, both in terms of the capital expenditure that is necessary to implement such a system, as well as in terms of significantly higher operating costs. In this regard, a flue gas recirculation system requires sufficient feed lines and a fan or blower system to transport the flue gas to the reburning nozzles from a point downstream of the reburning zone. The use of flue gas recirculation is also undesirable because it requires the introduction of additional reburn fuel to consume the additional oxygen that is present in, and carried with, the stream of recirculated flue gas.

It is therefore apparent that there remains a need for an improved means for the injection of reburn fuel without the need for recirculated flue gas or other carrier gas.

SUMMARY OF THE INVENTION

An apparatus and method are disclosed for high velocity injection of a reburn fuel into a stream of $NO_x$ containing combustion effluents above (i.e., downstream of) a primary combustion zone, without the use of recirculated flue gas or other carrier gas. The apparatus includes a fuel introducing member that has a fuel receiving end for receiving fluid fuel from a fuel source and a fuel injection end for injecting the fluid fuel into the stream of combustion effluents. A fuel passage is in fluid communication with the fuel receiving end and the fuel injection end of the fuel introducing member. A mechanism for increasing the velocity of the fluid fuel, without the need of a carrier gas, is associated with the fuel introducing member.

In accordance with one embodiment of the apparatus, the velocity increasing means comprises a nozzle with an end plate that has one or more holes. The cross-sectional area of the one or more holes of the nozzle end plate is less than the cross-sectional area of the fuel introducing device. Because of this differential in cross-sectional areas, the fluid fuel, which is typically provided at a low velocity source rate, exits the nozzle end plate at a significantly higher velocity (which may be at or, depending upon the nozzle structure, above sonic speeds).

In accordance with another embodiment of the apparatus, the velocity increasing means comprises a blower or compressor that is associated with the stream of reburn fuel and is located upstream of the fuel introducing member. In accordance with still another embodiment of the apparatus, the velocity increasing means comprises a constricted portion of the fuel passage of the fuel introducing member or, alternatively, a constricted portion of the upstream portion of the fuel supply line. In this latter embodiment, the portion of the reburn fuel system that is downstream of the constricted portion of the fuel supply line is generally of a size that maintains the same or a comparable cross-sectional area as the constricted portion of the fuel supply line.

Also disclosed is a method of injecting a fluid fuel into stream of combustion effluents containing $NO_x$, above (i.e., downstream of) a primary combustion zone, at a high velocity. The method comprises the steps of:

providing a source of fluid fuel;

providing one or more fuel injectors, the one or more fuel injectors each comprising a fuel introducing member, the fuel introducing member having a fuel receiving end for receiving fluid fuel from a fuel source, a fuel injection end for injecting said fluid fuel into the stream of combustion effluents, and a fuel passage that is in fluid communication with the fuel receiving end and the fuel injection end;

providing a means for increasing the velocity of the fluid fuel without the use of a carrier gas;

positioning the fuel injector at a location above (i.e., downstream of) the primary combustion zone of the effluent source; and providing a means of fluid communication between the source of fluid fuel and the one or more fuel injectors.

Other objects and advantages of the invention will become apparent upon reading the following detailed description and appended claims, and upon reference to the accompanying drawings.

DETAILED DESCRIPTION OF THE PREFERRED EMBODIMENTS

Figure 1:
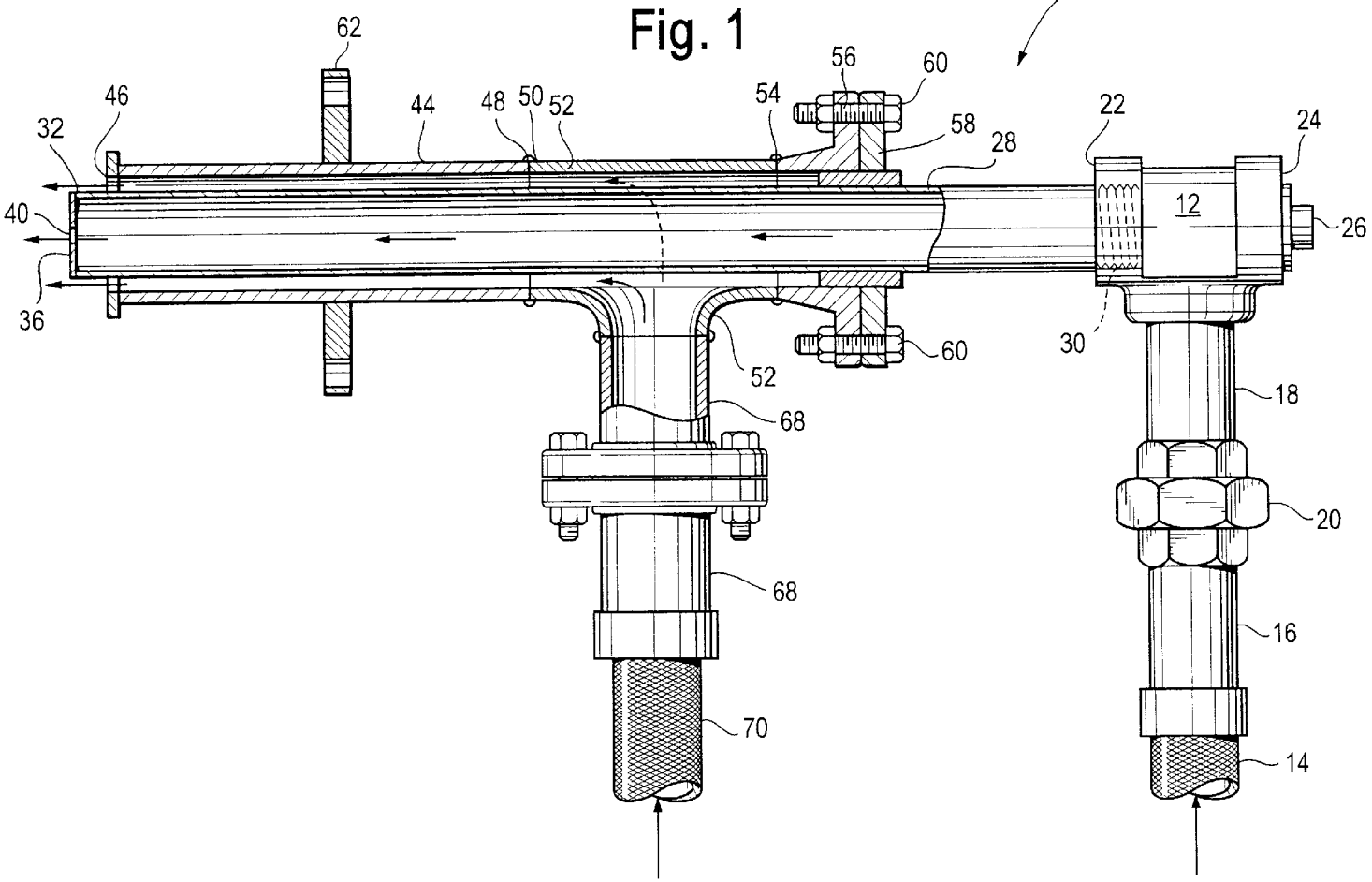
FIG. 1 is a side elevation, partially in section, of one embodiment of a high velocity fuel injector of the present invention.

Turning first to FIG. 1, there is shown one embodiment of a high velocity reburn fuel injector of the present invention. In FIG. 1, a fuel injector 10 has a threaded tee junction 12 that is connected to a fuel supply hose 14 by pipes 16 and 18 and a threaded union 20. The threaded tee junction 12 has opposing first and second ends 22 and 24, respectively. A plug 26 is threaded into the second end 24 of the threaded tee junction 12.

Figure 4:
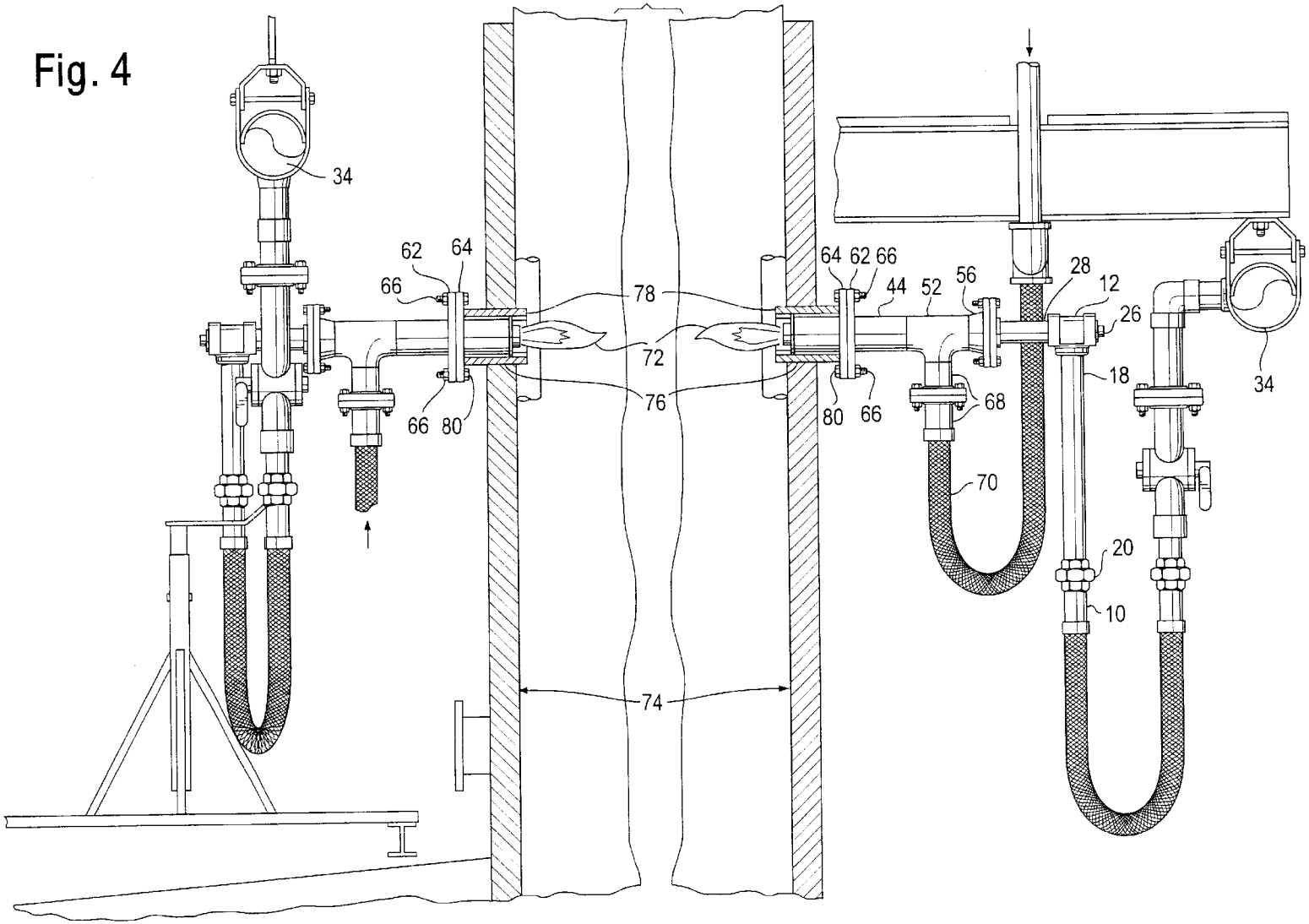
FIG. 4 is a side elevation, partially in section, of two high velocity fuel injectors of the present invention positioned along the walls of a furnace.

A nozzle member 28 is tubular in shape and has a threaded fuel receiving end 30 and a fuel injection end 32 that are in fluid communication with each other. The fuel receiving end 30 of the nozzle member 28 is threaded into the first end 22 of the threaded tee junction 12 and is thereby in fluid communication with the fuel supply hose 14 and fuel supply 34 (FIG. 4). In this manner, fluid fuel that is introduced into the fuel receiving end 30 of the nozzle member 28 will exit from the fuel injection end 32 thereof. It will be understood that the nozzle member need not be tubular, but may be of any shape cross-section. It will also be understood that the "fluid fuel" may be liquid or gaseous fuel. One appropriate reburn fuel has been found to be natural gas.

Figure 2:
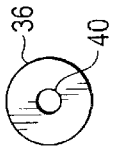
FIG. 2 is an isolated front elevation of a nozzle end plate for use with the high velocity fuel injector of FIG. 1.
Figure 3:
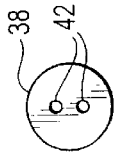
FIG. 3 is a front elevation of another embodiment of a nozzle end plate for use with a high velocity fuel injector of the present invention.

FIGS. 2 and 3 show two alternative nozzle end plates (36 and 38) for use in accordance with the injector embodiment of FIG. 1. Each of the nozzle end plates is shaped to reduce the open cross-section of the fuel injection end 32 of the nozzle member 28. Fluid fuel that has been introduced into the fuel receiving end 30 of the nozzle member 28 therefore passes through the nozzle member 28 and exits through the hole 40 (FIG. 2) or holes 42 (FIG. 3) of the nozzle end plate 36 (or 38 in the case of FIG. 3) in the form of a fuel jet. In this manner, the fluid fuel passes through the hole 40 (or holes 42) of the nozzle end plate 36 (or nozzle end plate 38) at a greater velocity ("exit velocity") than that at which it is introduced into the fuel receiving end 30 of the nozzle member 28. The exit velocity of the fluid fuel increases as the size of the hole(s) (e.g., the hole 40 of the nozzle end plate 36) and the number of holes are reduced. In this fashion, it is possible to maintain the desired penetration and entrainment of the fluid fuel with respect to the $NO_x$ containing effluent stream, without the use of recirculated flue gas.

Figure 5:
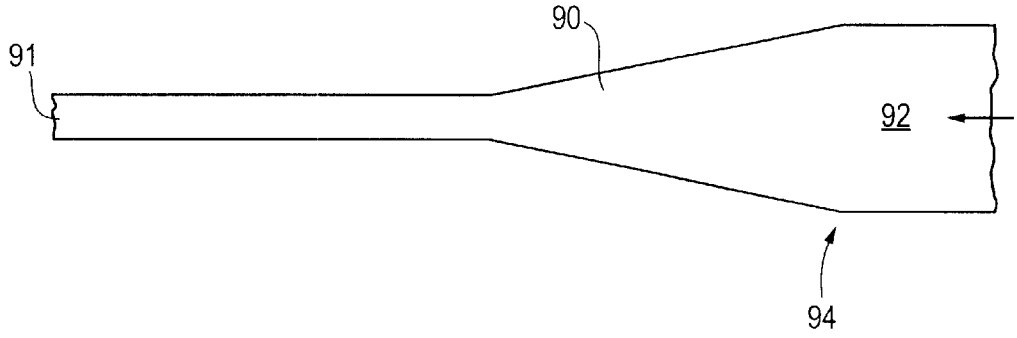
FIG. 5 is a diagrammatic axial section of a nozzle member for use with the high velocity fuel injector of the present invention.

Of course, the nozzle end plate need not be positioned on or near the fuel injection end 32 of the nozzle member 28, but could be disposed near the fuel receiving end 30 thereof or at any location between those points, provided that the downstream portion of the system is of a size that maintains the same or a somewhat comparable cross-sectional area as the nozzle end plate. For example, and as shown in FIG. 5, an inwardly tapered portion 90 of the interior 92 of the nozzle member 28 could also serve to increase the velocity of the reburn fuel that is fed into the nozzle member 28.

Figure 6:
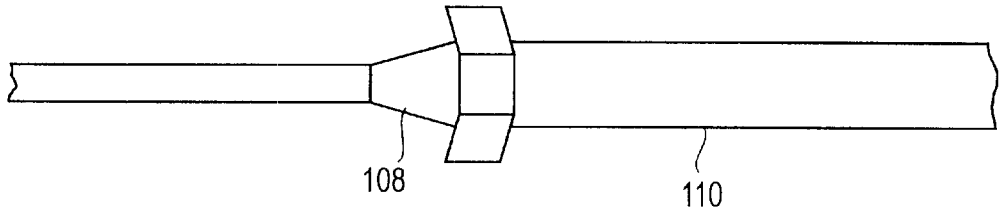
FIG. 6 is a diagrammatic axial section of a fuel supply line for use with the high velocity fuel injector of the present invention.

Alternatively, instead of a nozzle type mechanism, the velocity of the reburn fuel could be increased by other mechanisms. For example, as shown in FIG. 6, a constricted or tapered portion 108 of the reburn fuel feed line 110 could be associated with the reburn fuel supply hose 14 or pipes 16 or 18 or elsewhere upstream of the nozzle member 28. It will be understood, however, that the portion of the reburn fuel system that is downstream of the constricted or tapered portion 108 is preferably of a size that maintains the same or a comparable cross-sectional area as that of the constricted portion of the reburn fuel feed line 110.

Figure 7:
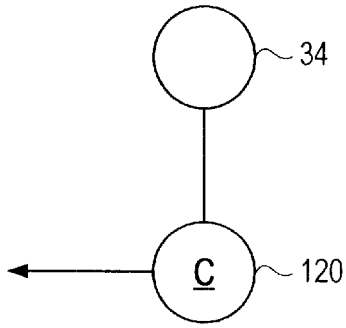
FIG. 7 is a diagrammatic axial section showing a fuel compressor for use for use with the high velocity fuel injector of the present invention.

It will also be understood that there are other suitable mechanisms by which the velocity of the reburn fuel may be increased. For example, a compressor mechanism 120 (FIG. 7) of sufficient force could be associated with the source of reburn fuel at a location downstream of the reburn fuel supply 34 and upstream of the nozzle member 28.

Jet penetration and entrainment rates are primarily controlled by the velocity, mass flow, and diameter of the jet flow. The use of smaller diameter hole(s) in the nozzle end plate, therefore, yields a higher velocity fuel jet, and hence a higher entrainment rate, even without the additional mass that is associated with the addition of recirculated flue gas. A high rate of entrainment may be achieved with such a high velocity fuel jet because the smaller diameter jet flow has a high ratio of surface area to jet volume. In this manner, the exit velocity of the fluid fuel from the nozzle member 28 can achieve sonic, and depending on the mechanism, even supersonic velocities (using natural gas).

Figure 8:
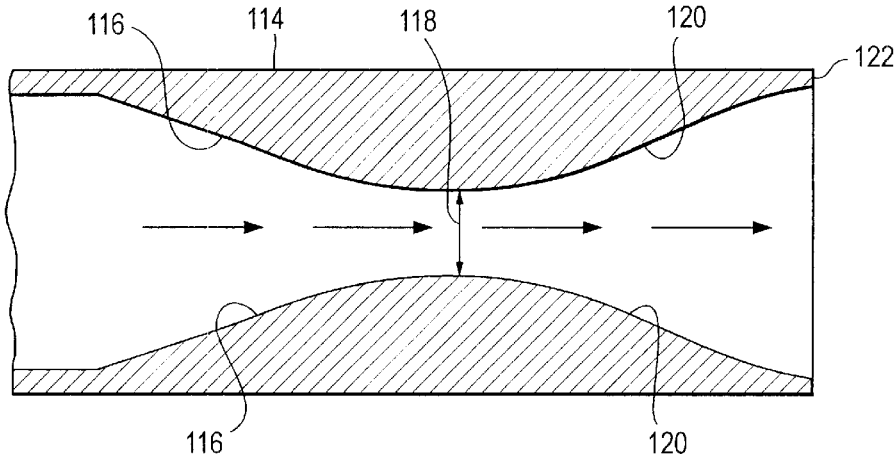
FIG. 8 is a diagrammatic axial section of a Laval nozzle for use with the high velocity fuel injector of the present invention.

More particularly, supersonic velocities can be achieved with, for example, the nozzle member embodiment shown in FIG. 8. FIG. 8 illustrates an axial cross-section of a supersonic Laval type nozzle 114. In FIG. 8, a Laval type taper 116 forms a constriction 118 which opens to form a second Laval type taper 120. The second Laval type taper 120 is preferably proximate to the fuel injection end 122 of the nozzle 114.

Thus, in accordance with the present invention, high velocity reburn injectors provide effective mixing, entrainment, and penetration of natural gas and other low mass reburn fuels (with the combustion products of the effluent stream) without the use of recirculated flue gas (or other carrier gases).

Figure 9:
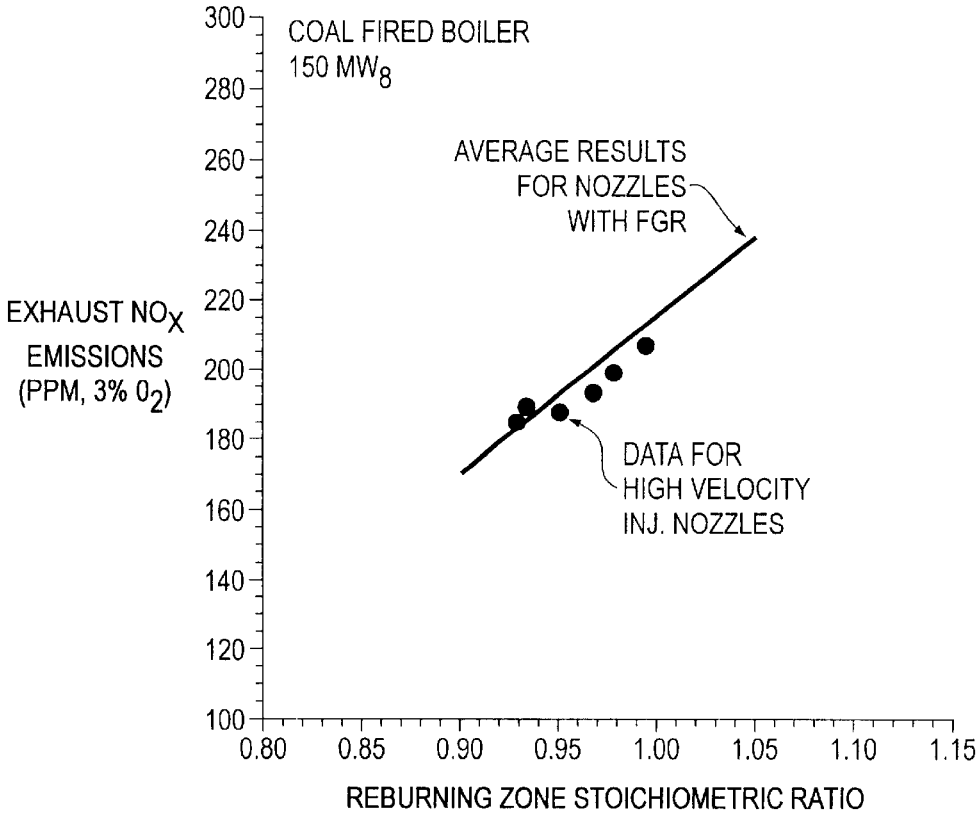
FIG. 9 is a graphical illustration that compares the $NO_x$ emissions of a coal fired boiler using the high velocity fuel injectors of FIG. 1 (with the nozzle end plate of FIG. 3) with the same boiler using conventional fuel injectors with recirculated flue gas.

With respect to the single hole end plate 36 as shown in FIG. 2, optimal results were obtained with a 150 megawatt boiler with a furnace cross section which was twenty-four feet deep and forty-two feet wide. Sixteen such fuel injectors were used, each of which consisted of a tubular nozzle member of two and ⅞ inches in diameter with an end plate having a single hole of ¾ of an inch diameter. The injectors were located above the main burner zone, with eight injectors positioned on two opposing side walls. The results are discussed below and are illustrated in FIG. 9. Similar results were achieved using a nozzle end plate of the configuration shown in FIG. 3. Specifically, a double hole end plate was used wherein each of the two holes were ½ inch in diameter (when using a nozzle member two and ⅞ inches in diameter). Although no significant advantage has been noted with respect to the double hole end plate 38 over the single hole end plate 36, the use of multiple holes may reduce the number of fuel injectors that are necessary to achieve the desired $NO_x$ reduction.

It will be understood that any number of holes of varying sizes may be used, provided that the fluid fuel is injected into the effluent stream with sufficient force to satisfactorily penetrate and entrain the $NO_x$ containing effluent stream, and thereby achieve the desired $NO_x$ reduction. Factors bearing upon the desired hole sizes of the nozzle end plate, as well as the number of high velocity injectors to be used, include the cross-sectional size and flow rate of the effluent stream, the number and location of the nozzle members, the type of reburning fuel (e.g., liquid or gaseous), and all factors which bear upon the jet velocity and chemistry of the $NO_x$ reduction process.

Generally, the desired hole size and number of high velocity injectors is selected to provide optimal distribution of the reburning fuel across the effluent stream using a minimum number of fuel injectors. The preferred size of the hole(s) of the nozzle end plate (or alternatively, the preferred size of the constricted portion of the nozzle member 28 or reburn fuel feed line 110) is such that it will produce a jet that achieves the desired level of penetration and mixing for the treatment of a selected portion of the effluent stream. The portion of the effluent stream that is treated depends upon the geometry of the flow path and the distribution of the effluent stream therein.

The nozzle member 28 and the nozzle end plate (e.g., nozzle end plate 36) may be formed from any suitable material that is capable of withstanding the temperature conditions associated with the desired placement of that portion of the fuel injector above the primary combustion zone. Suitable materials include stainless steel, refractory or ceramic materials, and carbon steel. A water cooled sheath (discussed below) may be disposed around the outside of the nozzle member, if desired.

As shown in FIG. 1, the nozzle member 28 may be disposed within a cooling jacket 44 for supplying cooling air or other gas to the nozzle member 28 when it is not in use in an otherwise operating furnace or other combustion source. This prevents the thermal breakdown of the nozzle member and thereby extends its useful life. The cooling jacket 44 has opposing first and second ends 46 and 48, respectively. The first end 46 of the cooling jacket 44 disposed proximate to the fuel injecting end 32 of the nozzle member 28 and may be attached thereto by anchor clips (not shown). The second end 48 of the cooling jacket 44 is affixed by welding or the like to a first end 50 of a T-shaped member 52. The opposing second end 54 of the T-shaped member 52 is connected to a neck flange 56 by welding or other suitable means. The neck flange 56 is fixedly positioned in a sealed manner over the nozzle member 28 by a blind flange 58 and screws 60.

A second blind flange 62, for mating with an opposing blind flange 64 of the furnace (FIG. 4), is fixedly disposed around the neck of the cooling jacket 44 at a location such that the fuel injecting end 32 of the nozzle member 28 is disposed in the furnace when the blind flanges 62 and 64 are connected by screws 66. The third end of the T-shaped member 52 is connected to a cooling gas supply (not shown) such as by pipes 68 and a cooling supply hose 70.

Turning now to FIG. 4, there are shown two arrangements by which one embodiment of the high velocity fuel injector 10 of the present invention may be utilized with an existing gas furnace, boiler, incinerator, and the like. In FIG. 4, existing reburn fuel ports 72 are disposed in opposing walls 74 of a furnace. The reburn fuel ports 72 each include a sleeve 76 that has a first end 78 that is disposed within the furnace and a second end 80 that is on the outside of the furnace. A blind flange 64 is fixedly disposed on the second end 80 of the sleeve 76. The blind flange 64 of the sleeve 76 is shaped for connection to the blind flange 62 (which is positioned on the cooling jacket 44) and is connected thereto by screws 66.

In assembling the fuel injector of the present invention, the fuel injecting end 32 of nozzle member 28 is inserted into the outside end 80 of the sleeve 76 of the reburn fuel port 72. When fully inserted, the nozzle member 28 extends to a point beyond the furnace wall 74 to a point within the furnace. At this point, the blind flange 64 of the sleeve 76 is connected to the blind flange 62 of the cooling jacket 44 by screws 66 as noted above. A tri-pod like stand 82 may be used to support the fuel injector assembly as shown in FIG. 4.

It will thus be appreciated that the high velocity fuel injectors of the present invention are of a more simple structure and a smaller size than conventional reburn fuel injectors. They are also less expensive to fabricate and install and may be used in conjunction with existing reburn fuel ports.

As noted above, the high velocity fuel injectors of the present invention also have significantly lower operating costs than conventional fuel injectors which use recirculated flue gas. Additionally, the capital costs of the high velocity fuel injection system of the present invention are significantly lower than that of a conventional system that uses recirculated flue gas. With respect to a 150 megawatt coal fired boiler, we have determined that the capital cost of constructing a reburning system with the high velocity fuel injectors of the present invention was sixty-four percent (64%) of the capital cost of constructing a reburning system with conventional reburn injectors that use recirculated flue gas.

To investigate the effectiveness of the high velocity fuel jets of the present invention, tests were conducted using a 150 megawatt coal fired boiler. As noted above, sixteen high velocity nozzles were used; each nozzle was equipped with a single hole end plate of ¾ inch in diameter. $NO_x$ emissions were measured using (1) the above-described embodiment of high velocity fuel injector of the present invention; and (2) conventional fuel introducing nozzles (with recirculated flue gas). FIG. 9 summarizes the results and illustrates that efficient $NO_x$ reduction is attainable with the high velocity fuel injectors of the present invention and that the level of $NO_x$ reduction meets or exceeds that which is attainable with conventional nozzles (using recirculated flue gas).

We claim as our invention:

1. A method of reducing $NO_x$ in a combustion furnace and the like by gas reburn comprising the steps of:

providing a source of combustion effluents containing $NO_x$;

providing a reburn zone downstream of the source of combustion effluents;

providing a source of fluid reburn fuel;

providing at least one high velocity reburn fuel injector in fluid communication with the source of the reburn fuel, the high velocity reburn fuel injector operative without a carrier gas, the high velocity reburn fuel injector including:

a fuel introducing member having a fuel receiving member for receiving fluid reburn fuel from the source of reburn fuel, a fuel injection end disposed downstream of the source of combustion effluents containing $NO_x$, and a fuel passage that is in fluid communication with the fuel receiving member and the fuel injection end; and introducing a substantially continuous jet of reburn fuel from the high velocity fluid injector into the reburn zone.

2. The method of claim 1 wherein the velocity increasing means comprises a compressor.

3. The method of claim 1 wherein the high velocity fuel injector comprises at least one nozzle plate.

4. The method of claim 3 wherein the nozzle plate has one or more holes and the one or more holes of the nozzle plate have an aggregate cross-sectional area that is less than the cross-sectional area of the fuel passage.

5. The method of claim 1 wherein the jet of reburn fuel is introduced into the reburn zone at or above sonic speeds.

6. The method of claim 1 wherein the jet of reburn fuel is introduced into the reburn zone at supersonic speed.

7. The method of claim 1 wherein the high velocity reburn fuel injector comprises a laval nozzle.

8. The method of claim 3 wherein the nozzle plate has at least one hole.

9. The method of claim 1 wherein the high velocity reburn fuel injector comprises a tapered portion of the fuel passage of the fuel introducing member.

* * * * *